US007299947B2

(12) United States Patent
Lingenhoff

(10) Patent No.: US 7,299,947 B2
(45) Date of Patent: Nov. 27, 2007

(54) METERING DEVICE FOR FLOWABLE PRODUCTS

(75) Inventor: Berthold Lingenhoff, Ahaus (DE)

(73) Assignee: Finnah Engineering u. Packaging GmbH, Ahaus (DE)

( * ) Notice: Subject to any disclaimer, the term of this patent is extended or adjusted under 35 U.S.C. 154(b) by 182 days.

(21) Appl. No.: 10/511,152

(22) PCT Filed: Apr. 16, 2003

(86) PCT No.: PCT/EP03/03961

§ 371 (c)(1),
(2), (4) Date: May 4, 2005

(87) PCT Pub. No.: WO03/086865

PCT Pub. Date: Oct. 23, 2003

(65) Prior Publication Data

US 2005/0224522 A1 Oct. 13, 2005

(30) Foreign Application Priority Data

Apr. 18, 2002 (DE) ..... 202 06 065

(51) Int. Cl.
*B67D 5/52* (2006.01)

(52) U.S. Cl. ..... 222/135; 222/387; 222/427; 222/434

(58) Field of Classification Search ..... 222/135, 222/386, 387, 427, 434, 439, 440
See application file for complete search history.

(56) References Cited

U.S. PATENT DOCUMENTS

| | | | | |
|---|---|---|---|---|
| 1,909,678 | A * | 5/1933 | Hillis | 141/352 |
| 2,588,057 | A * | 3/1952 | Thomas | 222/69 |
| 3,437,242 | A * | 4/1969 | Poitras | 222/135 |
| 4,917,158 | A * | 4/1990 | Lingenhoff | 141/258 |
| 6,655,556 | B1 * | 12/2003 | Bonningue | 222/386 |
| 6,811,058 | B2 * | 11/2004 | Voskuil et al. | 222/135 |

FOREIGN PATENT DOCUMENTS

DE 43 28 742 * 3/1995

* cited by examiner

*Primary Examiner*—Joseph A Kaufman
(74) *Attorney, Agent, or Firm*—Gudrun E. Huckett

(57) ABSTRACT

A metering device for flowable products, in particular, dairy products, is provided with a metering cylinder, a valve cylinder connected to the reservoir, a metering piston that is movable between an upper intake end position and a lower dispensing end position, and also has a mouthpiece closing the bottom of the metering chamber and having a coaxial cylindrical dispensing opening, and a central valve piston. The valve cylinder and the valve piston form a rotary control unit which, in a first rotary position, connects the metering chamber with a supply channel in the valve cylinder and, in a second rotary position, connects the metering chamber to an outlet channel.

16 Claims, 3 Drawing Sheets

METERING DEVICE FOR FLOWABLE PRODUCTS

BACKGROUND OF THE INVENTION

The invention relates to a metering device for flowable products, in particular, dairy products, comprising a metering cylinder, a valve cylinder coaxially arranged therein and connected at an upper end to the reservoir, a ring-shaped metering piston movable in the annular chamber between metering cylinder and valve cylinder between an upper intake end position and a lower dispensing end position, wherein the metering piston divides the annular chamber into an upper part connected to the product reservoir and a lower part forming the metering chamber, further comprising a mouthpiece closing the metering chamber at the bottom side with the exception of a coaxial cylindrical dispensing opening, and comprising a central valve piston movable into operating positions releasing or closing the annular chamber.

In known metering devices for liquid products (EP 0 286 785 A2), the product flows through a central valve cylinder into a metering chamber surrounding the valve cylinder; during this metering phase a dispensing opening coaxially extending in a mouthpiece at a bottom side is to be closed at the same time by a valve piston that is centrally movably arranged in the valve cylinder. For dispensing the product, the valve piston is returned axially into the valve cylinder into an opening position so that subsequently the product can be dispensed by means of a metering piston that is also axially movable in the metering chamber. These components that require a complex control result in a large outer diameter of the metering device so that the latter, when it is mounted in a substantially automatic filling device, requires a disadvantageously large space.

The invention concerns the problem of providing a metering device for flowable products that with minimal technical expenditure can be produced so as to have a slim size while enabling increased efficiency during the filling process by means of short adjusting strokes during control of its movable components provides.

SUMMARY OF THE INVENTION

The invention solves this problem with a metering device wherein the valve cylinder with the valve piston forms a rotatable control unit that, in a first rotary position, connects the metering chamber with the supply channel in the valve cylinder and, in a second rotary position, connects the metering chamber to an outlet channel. With regard to important additional embodiments reference is being had to the dependent claims.

The metering device according to the invention enables a significantly reduced outer diameter of the metering device by means of an assembly that combines the valve cylinder and the valve piston to a rotatable control unit so that several of these slim devices provide an advantageous compact mounting position within a narrow working space. In a preferred application, row arrangements of such devices in molding, filling, and sealing machines are provided so that such a machine can also be used for filling small cups having minimal relative spacing in pallet-suitable packaging units.

The control unit that is integrated into the metering device constitutes with control openings extending in the valve cylinder part and piston part, respectively, an assembly in which the conveying movements usually realized in piston metering devices by several axially moveable piston parts are partially replaced by a technically simpler and faster-to-execute pivot or rotational movement. This control movement can be initiated by a rotary drive of a simple design so that the optimally distributable product flow must be controlled only during sucking in and dispensing by means of a metering piston and its correlated stroke movement.

The control unit that is variable particularly in regard to its longitudinal dimensions can be reduced with minimal expenditure in the area of its inner diameter such that the surrounding outer metering chamber can be matched to different volumes to be metered. In this connection, a reliable filling of the metering chamber is possible even with comparatively minimal flow cross-sections in the control unit. The metering device exhibits because of the rotary movement in the area of the control unit short adjusting times so that the slim device overall can be operated with higher output and shorter cycle times.

BRIEF DESCRIPTION OF THE DRAWINGS

With regard to significant further details and advantages of the invention, reference is being had to the following description and drawings in which the metering device according to the invention is explained with the aid of an embodiment. The drawings show in.

DESCRIPTION OF PREFERRED EMBODIMENTS

Figure 1:
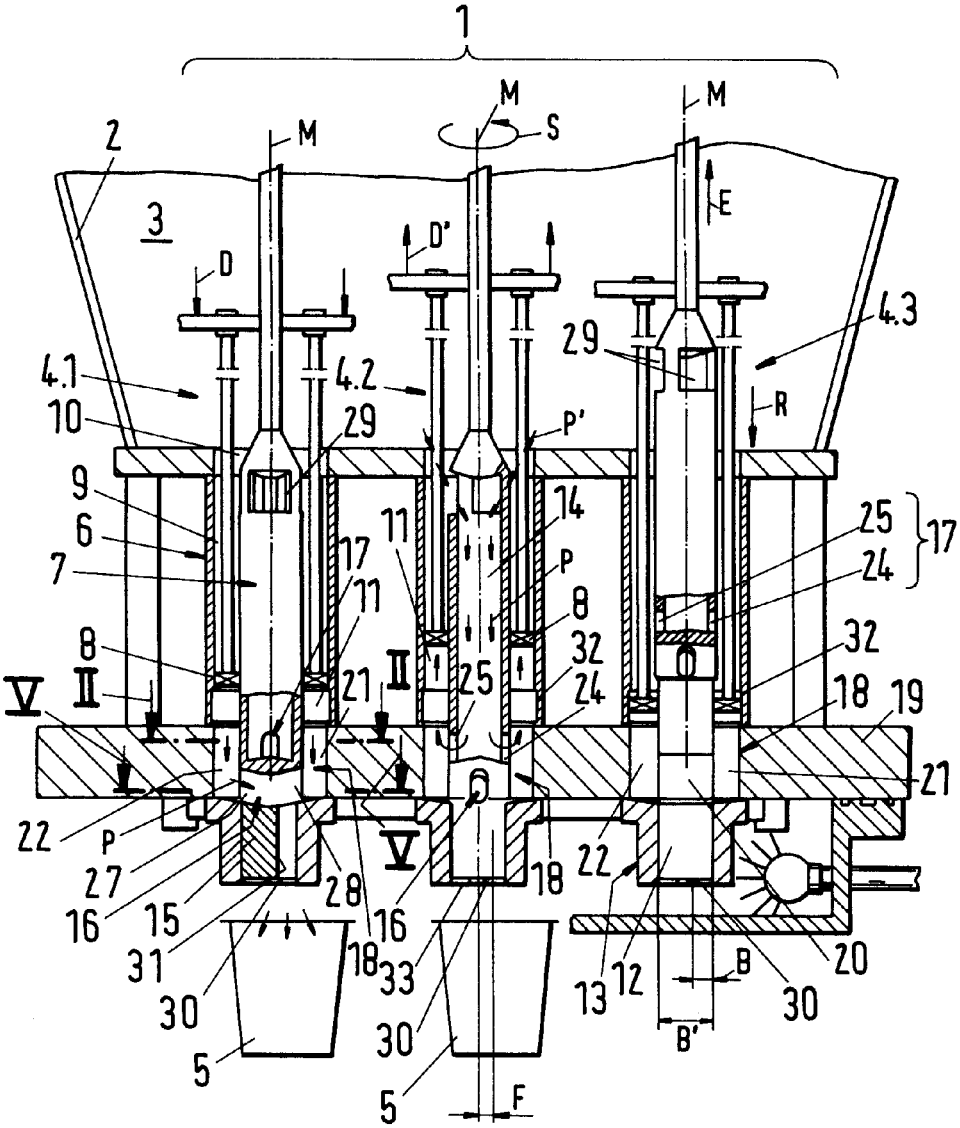
FIG. 1 a partially sectioned side view of metering devices provided in a filling unit, illustrating schematically different operating phases.

In FIG. 1, a filling device for dairy products is illustrated that is identified in its entirety by reference numeral 1 and comprises a product reservoir 3 closed by wall parts 2. Several metering devices 4 are connected to the outlet slide of this container 3. In the following, they are differentiated with regard to their different illustrated operating positions only by the reference characters 4.1, 4.2, and 4.3 but are comprised of identical component assemblies with regard to their construction. The metering devices 4 that operate according to the principle of piston metering devices are used for filling cups 5, respectively, wherein the filling device 1 can also be provided as a component of a molding, filling, and sealing machine (not illustrated in detail).

The metering device 4 that is in principle disclosed in EP 0 286 785 A2 is provided with a metering cylinder 6, a valve cylinder 7 coaxially arranged therein, and a ring-shaped metering piston 8. The metering piston 8 is axially movably arranged within an annular chamber 9 extending between the metering cylinder 6 and the valve cylinder 7 such that the metering piston 8 can be moved in accordance with the cycle control of the filling device 1 into an upper intake position or a lower dispensing position (arrows D and D').

The metering piston 8 divides the annular chamber 9 into an upper part connected in a passage area 10 to the product reservoir 3 and a lower part forming a metering chamber 11 for the product (arrow P). The metering chamber 11 in the metering cylinder 6 is closed at the bottom side by a mouthpiece 13 with the exception of a coaxial cylindrical dispensing opening 12. Moreover, a central valve piston 15 is provided that is axially movable between a position (metering device 4.2) engaging the dispensing opening 12 of the mouthpiece 13 and an upper release position (metering device 4.3).

In order to prevent convolution of the drawing according to FIG. 1, same components of the metering devices 4.1, 4.2, and 4.3 are not referenced individually in each illustration.

In the metering device 4 according to the present invention, the valve cylinder 7 that is constructively combined with the valve piston 15 forms an assembly that is provided as a rotatable control unit with which, by corresponding rotary movements (arrow S) about the vertical axis M, different operating positions can be reached so that only a lifting movement in the area of the metering piston 8 (arrows D, D') for conveying the product P is required. The control unit acts in such a way that in a first rotary position (metering device 4.2) the metering chamber 11 is connected to a supply channel 14 in the valve cylinder 7 and in a second rotary position (metering device 4.1 ) the metering chamber 11 is connected to an outlet channel referenced as a whole by numeral 16 through which the product P is conveyed into the cup 5, respectively.

Looking at the metering device 4.1 illustrated in FIG. 1, it becomes apparent that the valve piston 15 provided as an integral part of the unitary control unit constitutes the lower end of the valve cylinder referenced as a whole by numeral 7. The valve piston 15 constitutes at the same time the lower end of the supply channel 14. In the valve cylinder 7, directly above the inner topside of the valve piston 15, a transfer opening is provided that is referenced generally at 17 through which in the first rotary position (4.2) of the control unit the product P can be transferred into at least one axial transfer channel 18. This transfer channel 18 communicates with its upper end directly with the metering chamber 11, and the metering chamber 11 is closable in the area of its lower end in the first rotary position of the control unit (metering device 4.2). In the second rotary position, this transfer channel 18 is connected to the outlet channel 16 in the valve piston 15 (metering device 4.1).

For an optimal control of the product conveying flow P' out of the container 3, the control unit can be provided in the area of the valve cylinder 7 or the valve piston 15 with several of the afore described openings or channels so that a large product amount P can be supplied in a short period of time to the metering device 4 and dispensed into the cups 5.

In an expedient configuration, the control unit has two longitudinal grooves 21, 22 that are arranged in a support plate 19 of the device 1 so as to be staggered by 180° and so as to open at a bottom side of the annular metering chamber 11; they are provided as transfer channels 18 that are radially formed (FIG. 2) in an engagement opening 20 receiving the valve piston 15 when in its control position.

Figure 2:
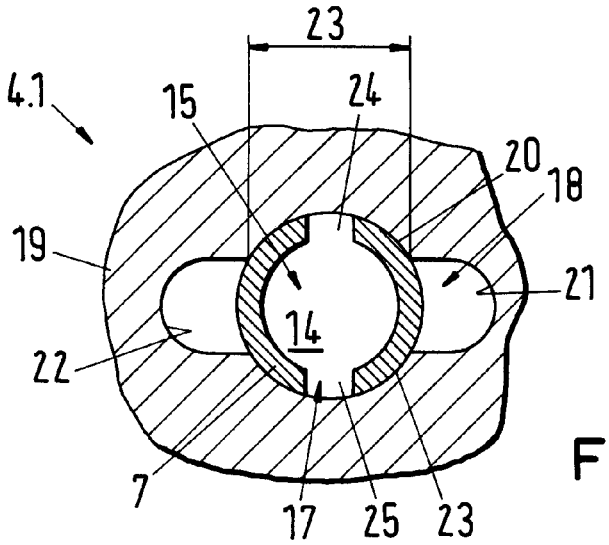
FIG. 2 a section illustration of the metering device in the area of a valve cylinder according to line II-II in FIG. 1.
Figure 3:
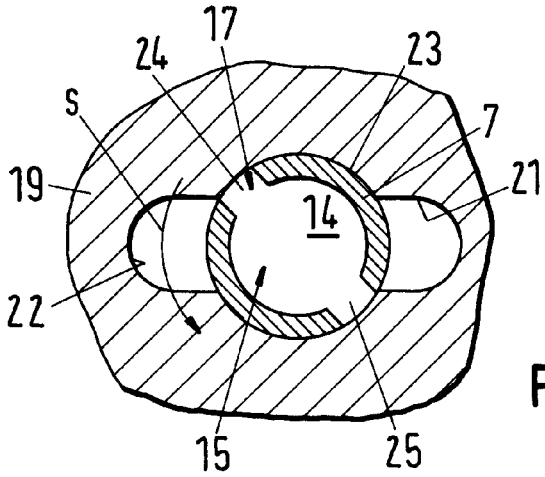
FIG. 3 and FIG. 4 a section view similar to FIG. 2, respectively, with the valve cylinder of the control unit in different rotary positions.
Figure 4:
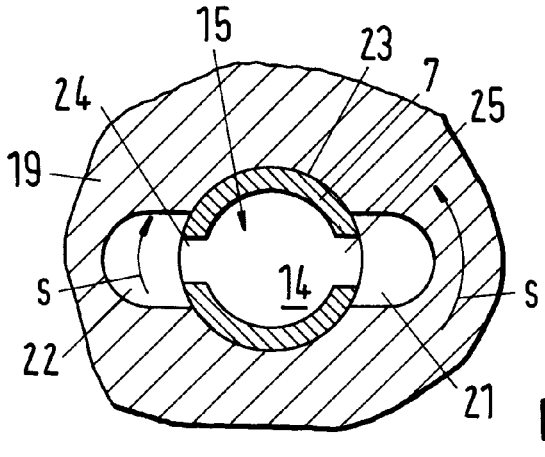

The section illustrations according to FIGS. 2 through 4 illustrate the engagement conditions of the valve cylinder 7 and the valve piston 15 in the area of the support plate 19 supporting all metering devices 4. Between the two longitudinal grooves 21 and 22, a curved section 23, extending in the circumferential direction and conforming to the cylinder contour of the valve piston 15 or the valve cylinder 7, is provided as a part of the engagement opening 20 wherein the correlated cylinder or piston part of the control unit rests sealingly against this area in a corresponding rotary position. When looking also at the vertical section view of FIG. 1 (metering device 4.3), it becomes apparent that the transfer channels 21 and 22 are covered from below by the mouth piece 13 closing them in the axial direction.

The section illustration according to FIG. 2 also shows that the control unit in the area of the valve cylinder 7 has two transfer openings 17 that are 180° opposed to one another and are in the form of a wall slot 24 and 25, respectively. In the area of the valve piston 15, two vertically spaced transverse openings 27 and 28 that are displaced by 90° to the wall slots and open into the outlet channel 16 are correlated with these two wall slots 24 and 25; they interact in the lower area with the longitudinal grooves 21 and 22 (FIG. 1, metering device 4.1).

For an optimal effect of this control channel system, the supply channel 14 is formed as a central bore extending in the valve cylinder 7 of the control unit; it has at its upper end area facing the product reservoir 3 wall penetrations 29 near the passage area 10 as a connecting opening to the reservoir 3 so that the product P' can be sucked in without impairment.

When looking at both metering devices 4.1 and 4.3, it is apparent that the control unit in the area of the outlet channel 16 extending within the valve piston 15 cooperates with a bottom opening 30 provided in the mouthpiece 13; its flow cross-section B extends across a partial area of the end face of the valve piston 15 or the diameter of the dispensing opening 12 (diameter B').

Figure 5:
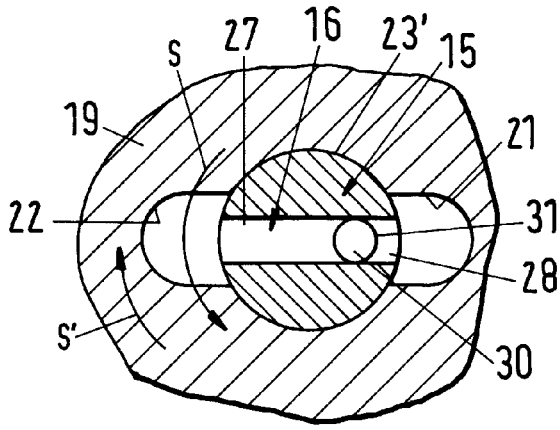
FIG. 5 a section view of a metering device in the area of the valve piston according to a line V-V of FIG. 1.

The outlet channel 16 has in the area of its transverse openings 27 and 28 a longitudinal channel 31 connected to these openings and extending at a parallel spacing to the longitudinal central axis M of the valve piston 15 which in the second rotary position of the control unit (metering device 4.1) can be moved into a congruent position with the bottom opening 30 of the mouthpiece 13 (FIG. 5). It is also conceivable that the outlet channel 16, instead of having the two transverse openings 27 and 28, is provided with one or several longitudinal channel part(s) (not illustrated) opening immediately into the respective transfer channel 18, respectively.

The bottom opening 30 of the mouthpiece 13 cooperating with the longitudinal channel 31 is arranged parallel and at a spacing to the longitudinal center axis M of the valve piston 15 (spacing F, metering device 4.2).

In the area of the metering cylinder 6, the metering chamber 11 is provided in close proximity to the lower transfer channel 18 or the two longitudinal grooves 21, 22 with a radially widened shape 32 which is required, in particular, when the filling device 1 as a whole is to be cleaned (metering device 4.3). In this operating position, the control unit is axially movable from its engagement position in the mouthpiece 13 into an upper service position (arrow E, metering device 4.3) and the metering piston 8 can be moved from its operating position in the metering cylinder 6 into the area of the widened shape 32 in the downward direction (arrow R) so that the metering piston 8 is released for cleaning the area of the annular chamber 9 as well as of the metering chamber 11.

The metering device with its valve position according to 4.1 shows an end phase during filling of the cup 5 wherein the product P is conveyed out of the metering chamber 11 through the transverse openings 26 and 27 into the longitudinal channel 31 and from there through the bottom opening 30 into the cup 5. The section illustration according to FIG. 5 shows the position assumed by the control unit in the area of the valve piston 15 in which the outlet channel (16) in the area of its transverse opening 28 is positioned in a 3 o'clock position such that from the two longitudinal grooves 21 and 22 acting as transfer channels the product P is forced into the longitudinal channel 31 and from there through the bottom opening 30 into the cup 5.

After completion of this filling process, after the metering piston 8 has reached its lower position in the movement direction D, the control unit is rotated in a rotary direction S about the longitudinal center axis M. In this connection, the channels in the area of the valve piston 15 are moved through an intermediate position according to FIG. 6 such that the longitudinal channel 31 reaches a 12 o'clock position and, in this way, a bottom plate 33 closes complete the passage for the longitudinal channel 31 in the area of the mouthpiece 13. At the same time, the outlet channel 16 in the area of its two transverse openings 27 and 28 reaches the curved section 23' within the support plate 19 so that these channel areas are also closed (FIG. 7).

Figure 6:
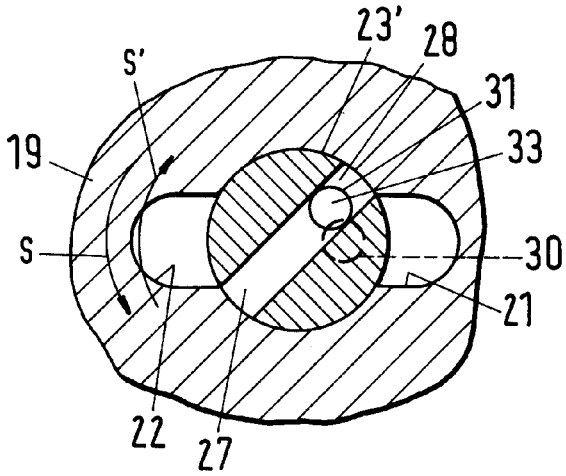
FIG. 6 and FIG. 7 a rotary position, respectively, of the control unit in the area of its control piston.
Figure 7:
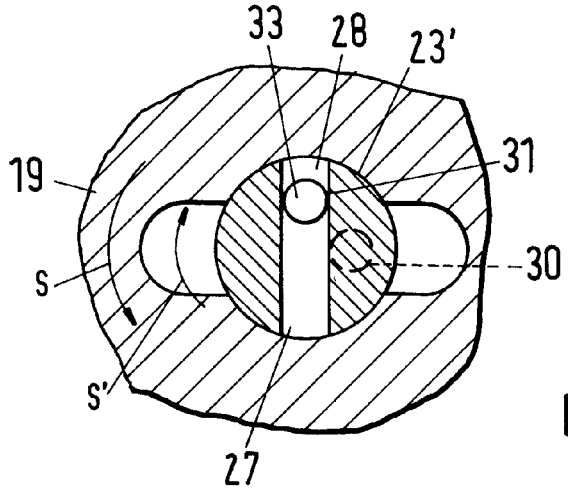

During the rotary movement S according to FIGS. 5 through 7, at the same time the channels arranged above the valve piston 15 and staggered by 90° are also rotated for the desired transfer of the product B' into the area of the valve cylinder 7. This rotary situation can be seen in the illustrations of FIGS. 2 to 4 wherein the wall slots 24 and 25 provided as transfer openings 17 from the supply channel 14 are moved from the closing position where they rest against the curved section 23 into the opening position displaced by 90° according to FIG. 4 (arrow S). In this position, a connection between the supply channel 14 and the transfer channel 18 formed by the two longitudinal grooves 21 and 22 is realized. When initiating the stroke movement D' in the area of the metering piston 8, a vacuum is generated within the metering chamber 11 and the metering chamber is again filled with the predetermined cup volume.

When carrying out a 90° return movement according to arrow S', the channel areas provided for dispensing in the area of the vale piston 15 are moved into the position according to FIG. 5, and the already described filling process of the cup 5 by means of the stroke movement D of the metering piston 8 is carried out.

What is claimed is:

1. A metering device for flowable products, the metering device comprising:

a metering cylinder;

a valve cylinder coaxially arranged in the metering cylinder, wherein the valve cylinder has an upper end and is configured to be connected with the upper end to a product reservoir;

an annular chamber defined between the metering cylinder and the valve cylinder;

a ring-shaped metering piston arranged in the annular chamber to be moveable between an upper intake position and a lower dispensing position;

wherein the metering piston divides the annular chamber into an upper part and a lower part, wherein the upper part is configured to be connected to the product reservoir and the lower part forms a metering chamber;

a mouthpiece closing a bottom side of the metering chamber and having a coaxial cylindrical dispensing opening;

a central valve piston movable into operating positions releasing or closing the annular chamber;

wherein the valve cylinder and the valve piston form a rotatable control unit, wherein the rotatable control unit has a first rotary position for connecting the metering chamber to a supply channel in the valve cylinder and a second rotary position for connecting the metering chamber to at least one outlet channel provided in the valve piston.

2. The metering device according to claim 1, wherein the valve piston constitutes a lower end of the valve cylinder and also a lower end of the supply channel in the valve cylinder, wherein the valve cylinder in an area directly above an upper side of the valve piston is provided with at least one transfer opening, through which, in the first rotary position of the control unit, a product can be transferred into at least one axial transfer channel having an upper end and a lower end, wherein the upper end communicates with the metering chamber, wherein, in the first rotary position of the control unit, the lower end of the at least one axial transfer channel is closed and, in the second rotary position, is connected to the at least one outlet channel.

3. The metering device according to claim 1, wherein several the at least one transfer opening, several of the at least one axial transfer channel, and several of the at least one outlet channel are provided.

4. Metering device according to claim 1, comprising a support plate, wherein two of the at least one axial transfer channel are provided, wherein the two axial transfer channels are arranged staggered by 180° in the support plate and open at a bottom side of the metering chamber.

5. The metering device according to claim 4, wherein the support plate has an engagement opening for the valve piston, wherein the two axial transfer channels are longitudinal grooves that extend radially away from the engagement opening for the valve piston.

6. The metering device according to claim 5, wherein in a circumferential direction of the engagement opening, the engagement opening has a curved section arranged between the longitudinal grooves, wherein the curved section matches a contour of the valve piston, wherein valve piston rests against the curved section in the first and second rotary positions.

7. The metering device according to claim 5, wherein the longitudinal grooves are covered at a lower end by the mouthpiece.

8. The metering device according claim 5, wherein the valve cylinder has two of the at least one transfer opening, wherein the two transfer openings are formed as wall slots positioned opposite one another and staggered by 180° relative to one another, wherein the wall slots open into the longitudinal grooves, respectively, wherein the valve piston has two transverse openings correlated with the wall slots, wherein the transverse openings open into the at least one outlet channel and are staggered by 90° relative to the wall slots.

9. The metering device according to claim 8, wherein the mouthpiece has a bottom opening, wherein the control unit in the area of the at least one outlet channel cooperates with the bottom opening, wherein the bottom opening has a flow cross-section that extends across a partial area of an end face of the valve piston.

10. The metering device according to claim 9, wherein the at least one outlet channel in the area between the transverse openings has a longitudinal channel that extends at least partially at a parallel spacing to a longitudinal center axis of the valve piston, wherein the longitudinal channel in the second rotary position of the control unit is at least partially in an overlap position with the bottom opening of the mouthpiece.

11. The metering device according to claim 9, wherein the bottom opening of the mouthpiece extends parallel and at a spacing to a longitudinal center axis of the valve piston.

12. The metering device according to claim 5, wherein that the at least one outlet channel has a longitudinal channel part opening immediately into one of the longitudinal grooves in the support plate.

13. The metering device according to claim 5, wherein the metering chamber in the area near the longitudinal grooves has a radially widened shape.

14. The metering device according to claim 13, wherein the radially widened shape has a length releasing the metering piston when the metering piston is in a lower extended position.

15. The metering device according to claim 1, wherein the control unit is axially movable into an upper service position in which the control unit is at least out of engagement with the mouthpiece.

16. The metering device according to claim 1, wherein the supply channel is a central bore extending in the control unit, wherein the central bore has an upper end remote from the valve piston, wherein the upper end is provided with wall penetrations as connecting openings that open toward the product reservoir.

* * * * *